US007654891B2

(12) United States Patent
Enomoto et al.

(10) Patent No.: US 7,654,891 B2
(45) Date of Patent: Feb. 2, 2010

(54) COIN FEEDING DEVICE FOR ADJUSTING TO DIFFERENT SIZE COINS

(75) Inventors: Minoru Enomoto, Saitama (JP); Masayoshi Umeda, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 501 days.

(21) Appl. No.: 11/582,935

(22) Filed: Oct. 18, 2006

(65) Prior Publication Data

US 2007/0087676 A1 Apr. 19, 2007

(30) Foreign Application Priority Data

Oct. 19, 2005 (JP) ..... 2005-304970

(51) Int. Cl.
*G07D 1/00* (2006.01)

(52) U.S. Cl. ..... 453/49; 453/56

(58) Field of Classification Search ..... 453/6, 453/49, 57, 3, 7, 10–13, 33–35, 56
See application file for complete search history.

(56) References Cited

U.S. PATENT DOCUMENTS

| | | | | |
|---|---|---|---|---|
| 1,813,296 | A * | 7/1931 | Kidwell | 453/12 |
| 3,233,778 | A * | 2/1966 | Cobb et al. | 221/232 |
| 5,868,614 | A | 2/1999 | Hirano | |
| 6,193,598 | B1 | 2/2001 | Tsuchida | |
| 6,398,637 | B1 | 6/2002 | Tsuchida | |
| 7,255,639 | B2 * | 8/2007 | Abe et al. | 453/18 |

FOREIGN PATENT DOCUMENTS

| | | |
|---|---|---|
| JP | 57-50776 | 3/1982 |
| JP | 8-171666 | 7/1996 |

* cited by examiner

*Primary Examiner*—Jeffrey A Shapiro

(57) ABSTRACT

The present invention provides a coin feeding device that can separate coins of multiple denominations that are different in diameter. A rotary disk has a circular base plate and a pushing out disk with a plurality of space radial projecting portions extending above the circular base plate. The spaces between the radial projecting portions form coin separating concave portions for receiving coins. The circular base plate can have cam grooves. A pivoting moving body can be driven by the cam grooves and can be positioned at either a radially inward surface of the separating concave portion or extended forward to discharge a coin. One side of the separating concave portions are curved as a coin pushing portion while the other side has a protruding portion that is cantilevered to extend into the concave portion and to project upward to remove any extraneous coin that may be carried by movement of the rotary disk.

16 Claims, 20 Drawing Sheets

COIN FEEDING DEVICE FOR ADJUSTING TO DIFFERENT SIZE COINS

BACKGROUND OF THE INVENTION

1. Field of the Invention

The present invention relates to a coin feeding device, which separates coins of multiple denominations that are different in diameter in a one by one procedure and specifically assures that only one coin is properly delivered at a time to the next process.

2. Description of Related Art

It has been known that the coins can be hooked by a pin fixed on an upper surface of a rotating selector disk, and the coins are thereby separated one by one, and are delivered to a transfer device of the next process, see Japanese Laid Open Patent Application No. 8-171666.

It is also conventional technology that coins can be received one by one on a fan-shaped or arc-shaped indentation concave portion which is opened on an upper peripheral face side of a rotating disk. The coins can be delivered to a transfer device for further processing, see Japanese Utility Model Laid Open Application No. 57-50776.

However, problems may exist in that extraneous coins can also be carried by the rotations of the rotary disk through a coin storage bowl

SUMMARY OF THE INVENTION

Generally, the separation of coins is regulated by the intervals of the pins in conventional rotary disks. Consequently, when a diameter difference between a maximum diameter coin and a minimum diameter coin is large, for example, in the case of a Sterling Pound, the maximum diameter is 28.5 millimeter for a two pound coin and the minimum diameter is 18 millimeter for a five pence coin it is difficult to use a fixed pin spacing. Since the pin intervals are also set in consideration of an acceptable allowance margin, there is a problem that two pieces of minimum diameter coins may enter between the same pair of spaced pins, thereby making it difficult to separate them.

In rotary disks having a fan-shaped concave portion of a size corresponding to a coin of a predetermined diameter, that is, a coin of one denomination, when coins of multiple different types in diameter are mixed and input, the fan-shaped concave portion is not suited for efficiently separating such coins one by one and feeding them to the next process step.

An object of the present invention is to provide a coin feeding device capable of separating coins, one by one, and feeding them to the next process even when coins of multiple denominations are different in diameter, and at the same time, providing a preventive structure in which the rotating disc does not feed the coins in two or more pieces in a radial direction, so that highly reliable coin processing can be performed.

To achieve this object, the coin feeding device according to the present invention can be configured as follows.

A coin feeding device, in which coins are held on a separating concave portion disposed on the upper face of the rotating disk, and after being separated one by one, are fed to the next process, comprises: a pushing-out disk provided on the upper face of the rotating disk and formed among projection portions in which separating concave portions extend in a multiple radial pattern; and a moving body is provided at one side of the separating concave portion and operates so as to push out a coin from the separating concave portion so that it is fed to a subsequent coin process step, wherein a protruded portion protrudes upward from the upper face of the pushing-out disk and is provided at a coin pushing portion formed at one side of the separating concave portion of the peripheral edge of the projection portion with a concave portion exit portion of the opposite side.

In this configuration, coins are accommodated in the concave portion, and are separated one by one. That is, the concave portion is a portion in which only one coin is seatable, and therefore, two pieces of coins having a minimum diameter are not accepted in the separating concave portion.

When the concave portion moves to a feeding or discharge position for the next process step, a moving body which forms a part of the concave portion moves so as to push out the coin from the concave portion regardless of size. By this movement, the coin can be positively fed to the next process step.

In the course of this movement, accompanied with the rotation of the rotating disk, a coin held in the separating concave portion will move upward, and any other coin that happens to be positioned at the top side of the held coin can be caught by the edge of the moving held coin. Since there is provided a protruded portion that faces the concave portion exit of the top end of the rotating disk, this protruded portion can operate to push upward the surplus coin from below that is just about to line up and enter the concave portion together with the held coin, thereby releasing the second coin and separating it from the lower coin. Hence, even if the held coin moves, it moves so as to slip under a front coin so that an edge bumping with this coin does not occur nor is the coin hooked and lifted and carried by the coin in the concave portion. Hence, only coins which are held in the separating concave portion are fed out one by one, and the coin processing at the next process step, for example, a coin processing such as denomination discrimination and the like can be performed with high accuracy.

Alternatively, a coin feeding device provided with an elastic baffle plate having its top end contacting an outer peripheral portion upper face of the rotating disk can be provided. In this configuration, even if there exists coins which are inappropriately connected or stacked and move in the radial direction with the desired coin inside the separating concave portion, there also exists an elastic baffle plate at the moving destination of the coins, so that coins will hit against and press the baffle plate. At this time, the coins receive a rebound elastic force according to the pressing force from the baffle plate, and therefore, the unwanted coins are dropped. As a result, one piece only of a normal coin remains in the separating concave portion, and is pushed out so that an erroneous two coin feeding is prevented. Hence, accurate denomination discrimination by a denomination discriminating device and the like is performed, and the coin processing at the next process step can be performed with high accuracy.

The coin feeding device can be provided with a baffle plate having its top end contacting also the peripheral edge of a projection portion. In this configuration, the top end of the baffle plate slides not only relative to the upper face of the rotating disk, but also with the peripheral edge of a projection portion of the pushing-out disk, and is installed so as to occupy an outer peripheral portion of the rotating disk with a sufficient size, and therefore, almost all the coins trying to ride above a normal coin in the indentation can be effectively excluded.

A coin feeding device, in which the baffle plate can be an elastic plate formed by synthetic resin. In this configuration, the baffle plate can be easily manufactured from a synthetic resin, and is low in price, while providing a sufficient rebound elastic force.

A coin feeding device, in which the baffle plate is disposed in a rotating route of the rotating disk at a position before the moving body starts a coin pushing-ahead operation. In this configuration, since the elastic baffle plate is disposed in the rotating route at a position just before the moving body enters the operating process, a surplus coin connected with the normal coin and lifted up will abut against the baffle plate before the moving body starts its operation, and by that snapping force, the coin is positively knocked off the rotary disk, and therefore, the process by which the moving body lifts the normal coin is unaffected. For this reason, without being affected by the existence of the baffle plate, the moving body can perform the operation of normally pushing out the coin.

A coin feeding device in which a R shaped chamfering portion is provided in the outer peripheral portion of the projection portion of the pushing-out disk within a predetermined range. In this configuration, the pushing-out disk is chamfered in the shape of an R in its outer peripheral edge portion in a predetermined range, and therefore, any coin that sometimes ends up riding on the outer peripheral edge portion of the pushing-out disk by a centrifugal force and the like is easily slipped off by this R-shaped chamfering portion. Hence, a potential trouble such as a few pieces of the coins of a small diameter and the like being fed out while moving on the outer peripheral portion of the rotating disk is eliminated, thereby improving a processing accuracy of coin discrimination and the like performed at the next process step.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

BEST MODE OF CARRYING OUT THE INVENTION

Figure 1:
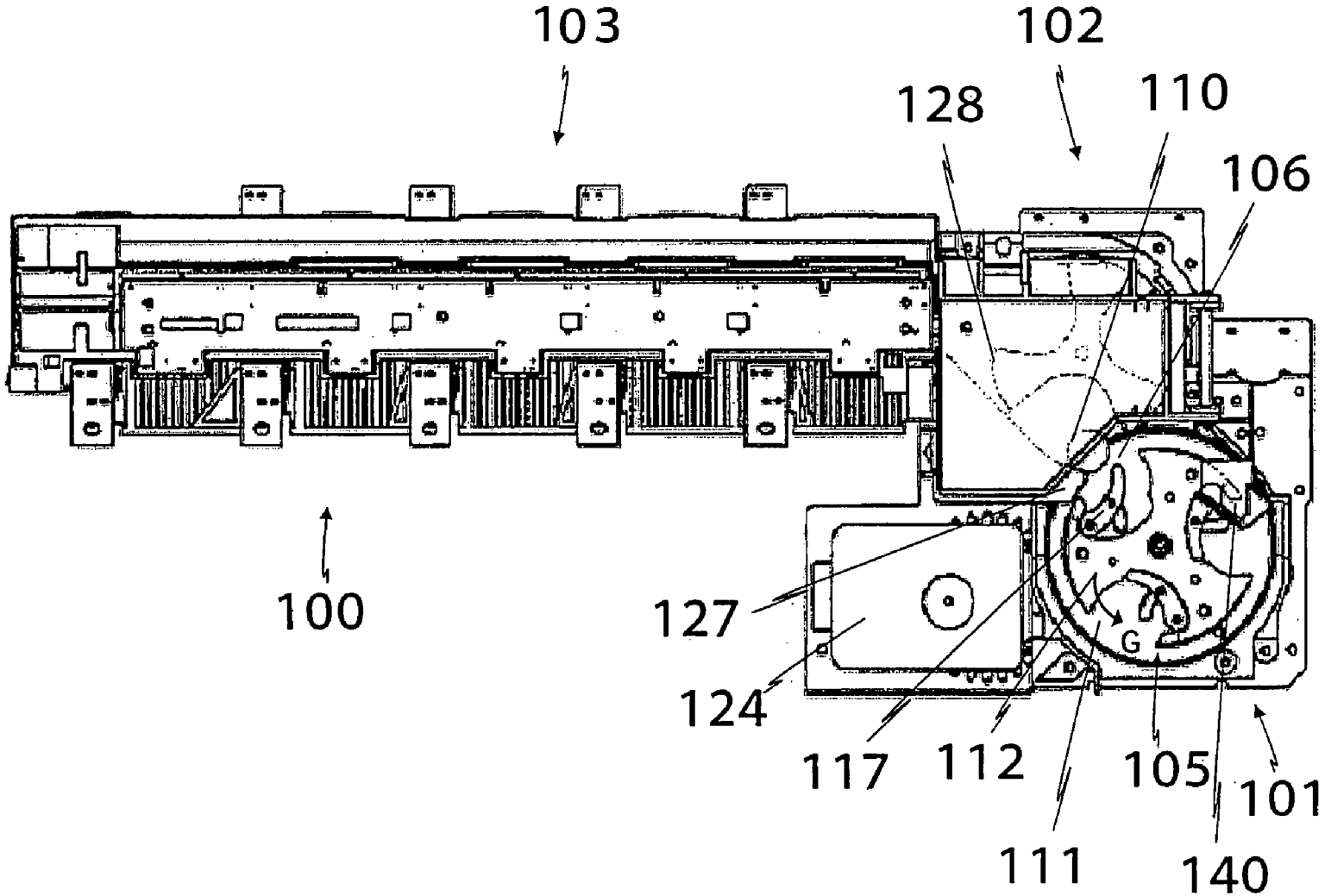
FIG. 1 is a schematic front view of a coin processing device according an embodiment of the present invention.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The term coin used in the present specification includes a monetary coin, token and medal or the like, and its shape includes circular and polygonal forms.

A coin feeding device, in which coins (110) are held on a separating concave portion (138) disposed on the upper face of the rotating disk (112), and after being separated one by one, they are fed to the next process step, comprises: a pushing-out disk provided on the upper face of the rotating disk and formed among projection portions in which the separating concave portions extend in multiple radial patterns; and a moving body provided at one side of the separating concave portion and operating so as to push out the coin from the separating concave portion when fed to the next process. The protruded portion protruded upward from the upper face of the pushing-out disk is provided at the coin pushing-ahead portion formed at one side of the separating concave portion of the peripheral edge of the projection portion and a concave portion exit portion of the opposite side. An elastic baffle plate with its top end contacting the outer peripheral portion top face of the rotating disk is disposed in the rotating route of the rotating disk, and moreover, the baffle plate also contacts the peripheral edge of the projection portion. The baffle plate can be comprised of an elastic plate of synthetic resin. The baffle plate is disposed in the rotating route of the rotating disk at a position just before the moving body starts an operation of pushing out a coin, and further, an R shaped chamfering portion is disposed on the outer peripheral edge portion of the projection portion of the pushing-out disk within a predetermined range.

EMBODIMENT

The present embodiment is a coin feeding device for a coin processing device which can accommodate a plurality of different coins or token configurations such as eight types of coins used in Europe including 2 Euro, 1 Euro, 50 Cent, 20 Cent, 10 Cent, 5 Cent, 2 Cent, and 1 Cent which are the currencies of the European community. A single coin feeding device can retain each coin denomination, and can pay out a predetermined number of coins of the predetermined denominations based on a delivery support.

In FIG. 1, a coin processing device 100 includes a coin delivery device 101, a denomination discriminating device 102, a coin transfer device 103 for separating the coins, and an unillustrated coin selecting device provided inside the coin transfer device 103 to discharge coins of a particular denomination.

That is, the coin feeding device 100 is provided with a rotating disk 105 which separates and feeds the coins one by one from a bulk supply of coins and by the operation of the rotating disk 105, the coins are fed one by one to a denomination discriminating device 102. A coin 110 is fed to the denomination discriminating device 102 through a coin delivery opening 106 provided on the upper part position of the coin feeding device 101. Inside the denomination discriminating device 102, authenticity of the coins and discrimination of the denominations are performed by a magnetic sensor and the like as known in this art, though not illustrated, and after that, the coins are sent to the transfer device 103 for the next process step, and in the midst of the transferring the coins in the predetermined route, they are separated according to denomination by the coin selecting device for example with a mechanism that opens and closes a predetermined gate.

The coin feeding device 100 will be further described with reference to FIGS. 2 and 4. The coin feeding device 100 includes the rotating disk 105, a coin retaining bowl 104 for retaining the coins, and a cylinder shaped retaining ring 107 positioned so as to surround the rotating disk 105 at the underneath of the retaining bowl 104. Coins of a plurality of denominations are inputted from a coin inputting port (not shown) and are guided and dropped into a retaining portion at the underneath from an opening port of the retaining bowl 104 and are retained in the shape of a bulk pile of coins.

The rotating disk 105 comprises a separating concave portion 113 which can accommodate the coins, one by one, and is installed in an inclined manner at the bottom of the retaining ring 107 at a predetermined angle to a vertical plane. The rotating disk 105 is rotated in a constant rotational direction at a predetermined velocity, that is, counter-clockwise as shown by an arrow marked G FIG. 2 of in the embodiment. The rotating disk 105 comprises a rotating circular plate 111 which forms a base and an upper pushing out disk plate 112 coaxially fixed in a stack like manner on an upper face 111S of this rotating base circular plate 111 and made of an approximate Y shaped plate having three spaced concave portions divided at approximately equal intervals by the radially projection portions 115. An approximately semi-circular separating concave portion 113 is formed on the upper surface of the rotating circular plate 111 in a space between the respective projection portion 115*s*. The projection portion 115 of the pushing-out disk 112 and a moving body 117 will be described subsequently.

A depth of the separating concave portion 113, in other words, a thickness of the pushing-out disk 112 is formed slightly shallower than the thinnest coin thickness from among, for example, the eight types of Euro denominations. Obviously other types of currency such as United States of America currency coin could be used.

The plate is not limited to a Y shaped plate, but may be a plate in the shape of multiple projection portions formed in a radial pattern. Further, the rotating circular plate 111 and the plate, that is, the pushing-out disk 112 can be alternatively integrally formed by resin having sufficient metal or abrasion resistance as one plate to form the rotary disk.

One side of each of the separating concave portions 113 between the projection portions 115 is provided with a moving body 117 which can perform a pivoting motion with a pivot axis 120 as a support point. The separating concave portion 113 is formed as an approximately semi-circular separating concave portion on the rotating disk 111 by this moving body 117 and the concave portion between the projection portions 115. In the projection portion 115, the other side of the concave portion is formed with a coin pushing portion 121 in which a slightly concaved concavity is formed, and which operates so that a coin 110 is accommodated in this concavity and pushed and transferred by the portion 121. Opposite to this coin pushing portion 121, is an arched receiving portion 118 for receiving the moving body 117 in the separating concave portion 113.

Here, the separating concave portion 113 is set to a dimension such that two coin pieces lined up of the smallest diameter coins will not be accommodated, but one piece of the largest diameter coin will still be accommodated.

Figure 2:
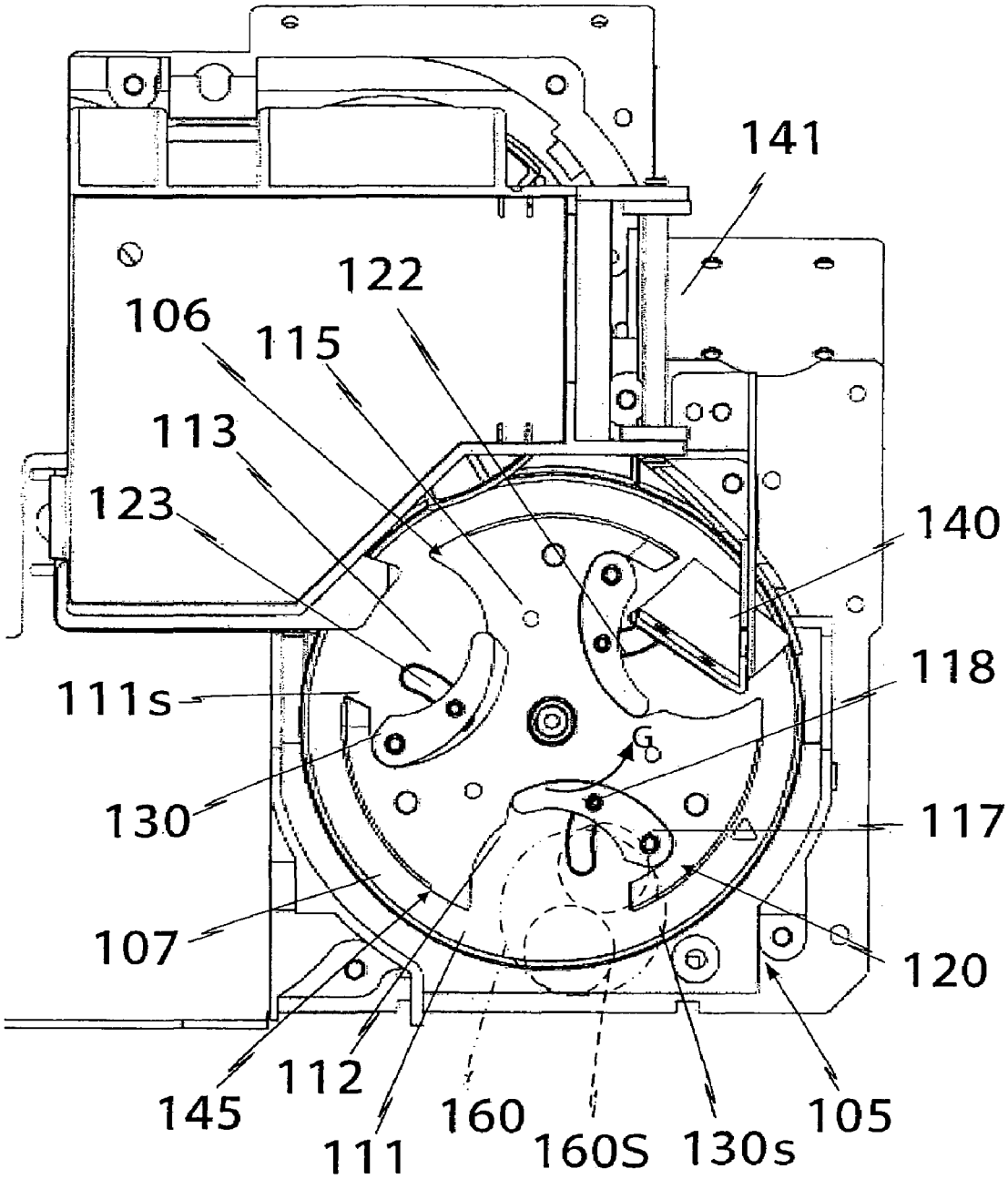
FIG. 2 is an oblique view showing a coin feeding device which is a major component of the coin processing device according to the embodiment of the present invention.
Figure 3:
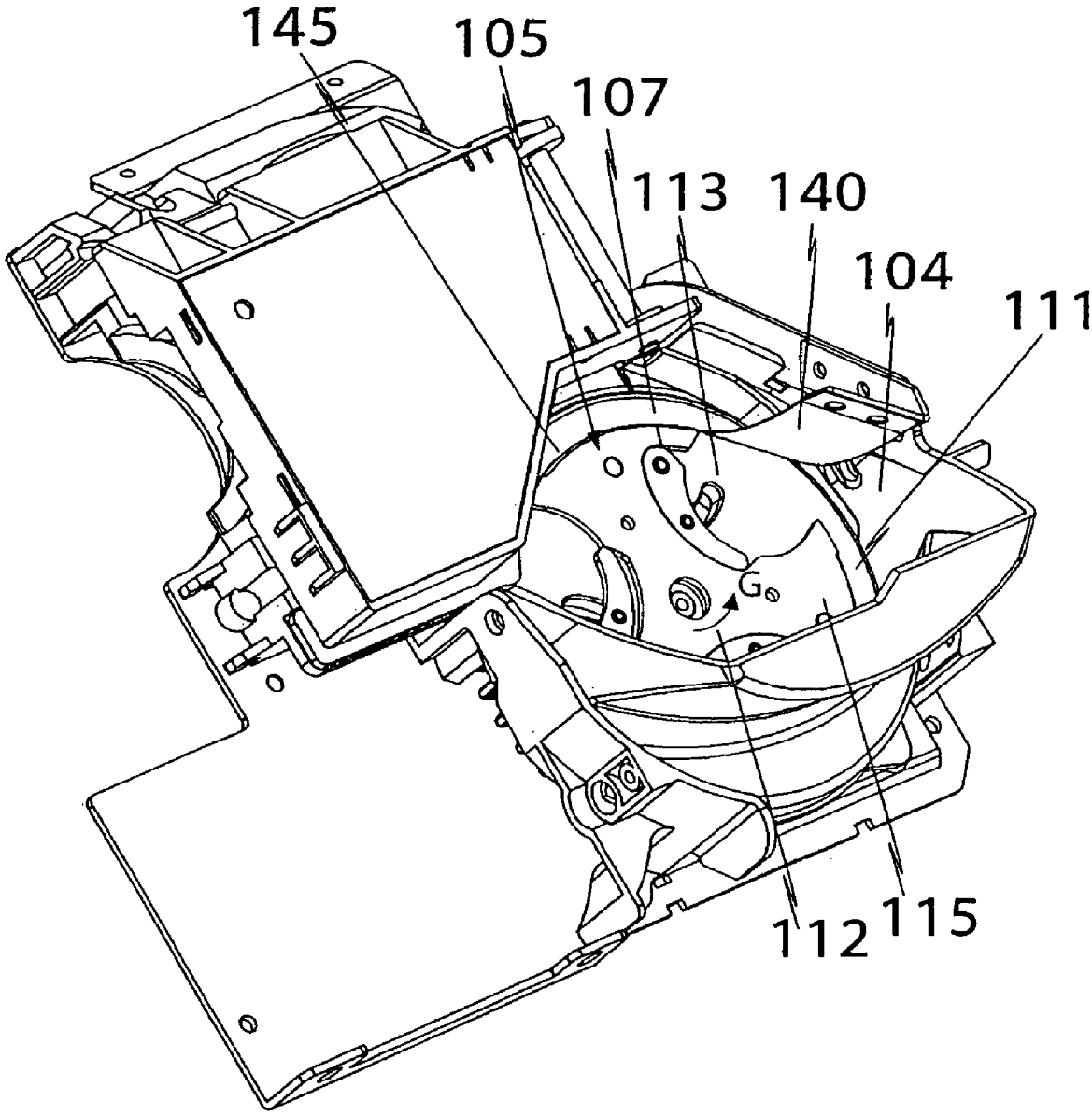
FIG. 3 is a front view of the coin feeding device of the embodiment of the present invention.

As shown in FIG. 2, the separating concave portion 113 has a size as displayed by an assumed line circle 160, and is set to a size unable to accommodate two pieces of minimum diameter coins 110*s* inside this assumed line circle 160, that is, a size below two times the diameter of the minimum diameter coin 110*s*.

Consequently, the separating concave portion 113 will not accommodate two pieces of the minimum diameter coins 110*s* lined up in a radial direction of the rotating disk 105.

The moving body 117 is usually located in a resting state shifted to the back side of the concavity, as show in FIG. 2, so as to leave an operative opening for the separating concave portion 113 to receive coins from a storage bowl, and when moved to a predetermined position by a pivoting motion, feeds the held coin 110 in the peripheral direction of the rotating plate 111. The movement of the moving body 117 at this predetermined position is performed along the rotating route of the rotating disk 105 slightly in the downstream vicinity a coin delivery opening 106 formed so that the coin can pass through to the denomination discriminating device 102 at the upper part of the retaining ring 107. When passing though the opening 106, the moving body 117 performs a return back operation so as to be accommodated in the receiving portion 118 formed at one side of the concavity or indentation.

Figure 4:
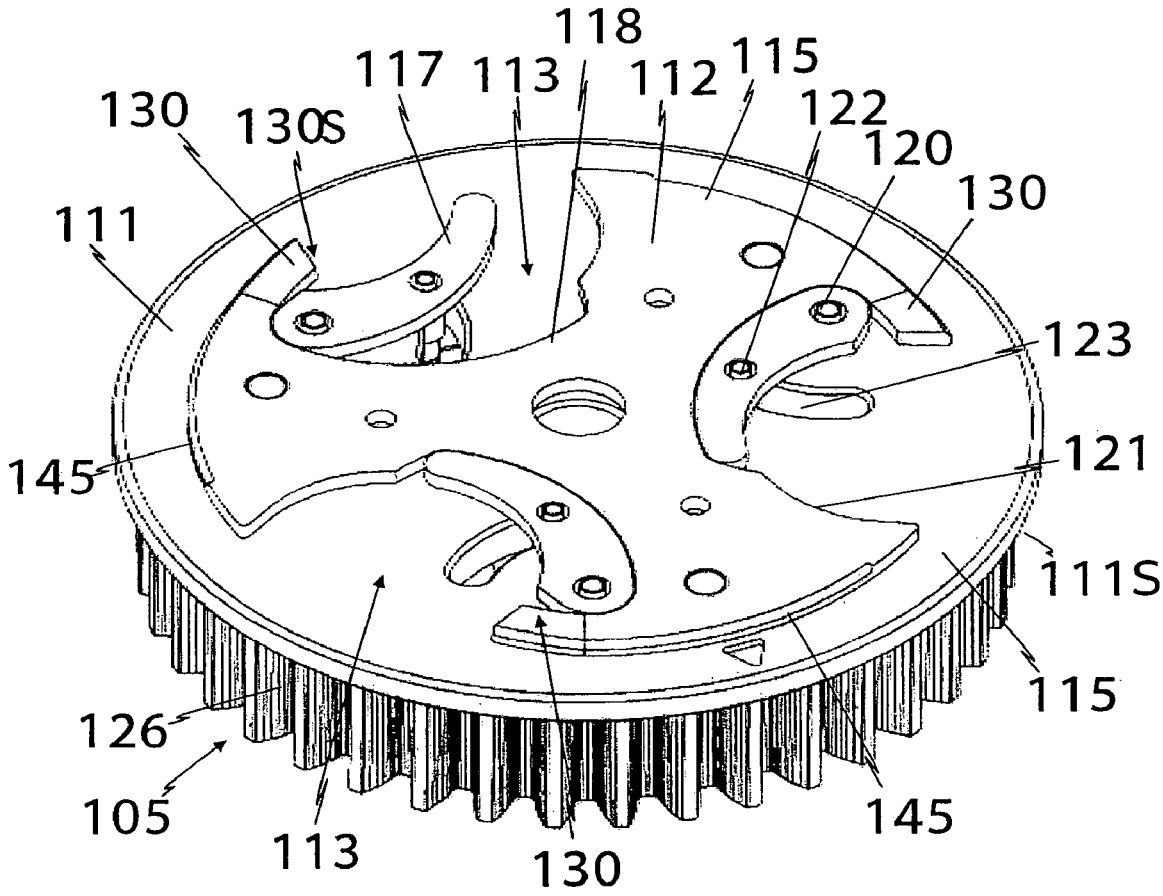
FIG. 4 is an oblique view of a rotating disk improved so that a coin connected feeding of the present invention can be prevented.

Such movement of the moving body 117 is made possible by a groove cam and the like by utilizing the rotating movement of the circular plate 111, see FIG. 4. That is, the midpoint of the moving body 117 is fixed and provided with a pin 122 or follower, and this pin 112 is inserted downward into an arched pass-through hole forming a cam groove 123, which is formed with the pivot axis 120 as a center, and which is formed in the rotating circular plate 111 of the rotating disk 105.

Further, a drive mechanism may be used, in which this pin 122 is allowed to be slidably inserted into a groove cam provided at the underside of the rotating circular plate 111 through a driven body such as a roller and the like. The rotating disk 105 is rotated by an electric motor 124. The rotation of the electric motor 124 is transferred to a reduction gear 126 formed at an underneath peripheral surface of the circular plate 111 shown in FIG. 4 through a speed reducer, and the rotating disk 105 is rotated at a predetermined speed. Close to the opening 106 of the denomination discriminating device 102, there is provided a knife shaped coin receiving portion 127 for receiving any coin 110 pushed out by the moving body 117 operated at the predetermined discharge position. There is also provided a rotating wheel 128 for feeding the coin guided by a receiving portion 127 as schematically shown in FIG. 1.

Consequently, with the rotating disk 105 configured as described above, the coins which are bulk-loaded in a storage bowl holding portion are agitated, and moreover, each piece of the coins is held one by one by a respective separating concave portion 113 and moved upward, and at a point of time when it comes to a predetermined discharge position above the rotating center, it is pushed out in a radial peripheral direction from the separating concave portion 113 by the moving body 117. The pushed out coin passes through the opening portion 106, and is fed into the denomination discriminating device 102 through the coin receiving portion 127, and after the coin is discriminated according to the denomination, it is further sent to the transfer device 104 by the rotating wheel 128.

In the projection portion 115 of the pushing out disk 112, the projection portion 115, at a side disposed with the moving body 117 is provided with an upwardly protruded portion or ramp 130 formed and bent upward on a peripheral edge of the disk plate 112. A rotating disk 105 provided with such a protruded portion 130 at the top end is a characteristic of the present invention. The protruded portion 130, as described later, exists in order to separate a surplus held coin protruded upward from the separating concave portion 113 which has a depth approximately of the thinnest coin so that another coin is not hooked and lifted. Further, this protruded portion is at a cantilevered peripheral edge of the projection portion 115 extending into the concave portion 113, and is positioned by facing a concave portion exit of the opposite side of the coin pushing portion 121 in the separating concave portion 113. In the separating concave portion 113, when a coin is entered, a gap is created between the coin and the top end of the projection portion 115, that is, the top end of the protruded portion 130, and though there is the possibility that another coin enters there, since the top end 130*s* of the protruded portion 130 is adapted on the assumed circle line 160 where two pieces of the coins can not enter, the coin is not allowed to enter this gap.

In general, in the coin feeding by the rotating disk 105, the separating concave portion 113 in which the coin enters is actually a concave portion formed between the inner edge of this moving body 117 and the coin pushing portion 121, and is a flat groove opened in the upper surface side and the peripheral surface side. Here, the depth of the separating concave portion 113, in other words, the thickness of the pushing out disk 112 for pushing out the coin is, as described above, formed slightly thinner than the thinnest coin thickness among the eight denominations.

Figure 7:
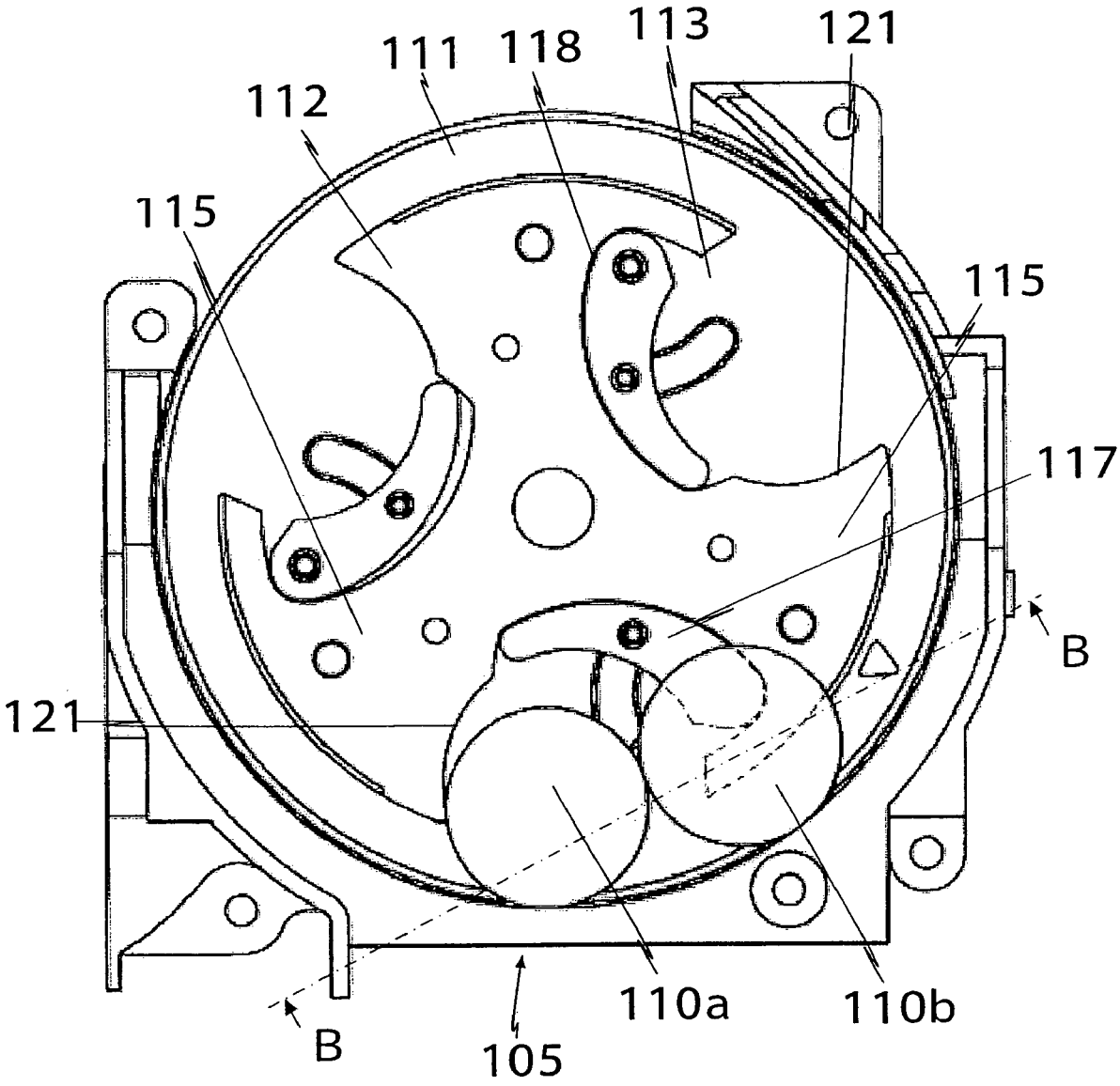
FIG. 7 is a schematic front view for explaining a trouble of the coin feeding by the rotating disk before improvement of the present invention.
Figure 8:
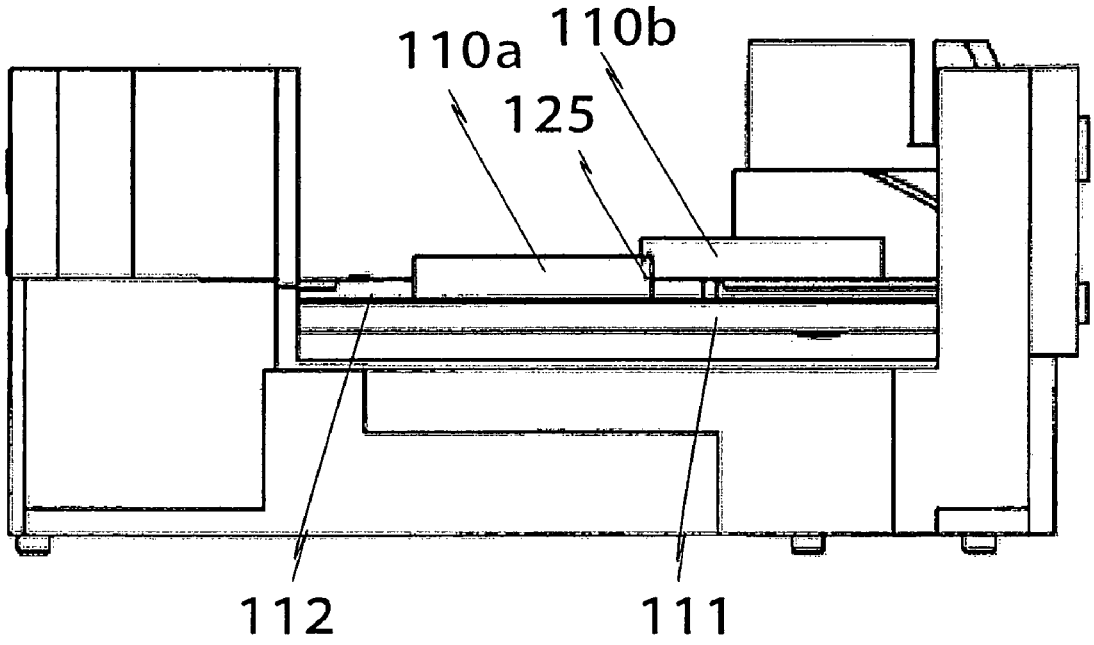
FIG. 8 is a sectional view cut along the line B-B in FIG. 7.

Consequently, in the case of a flat rotating disk having no protruded portion 130, as shown for comparison in FIGS. 7 and 8, when a coin 110*a* having a certain thickness is held in the separating concave portion 113, by the difference of thickness between this held coin 110*a* and the pushing out disk 112, the edge of the coin 110*a* is put into a state sprung out from the upper surface of the pushing out disk 112, and another coin easily rides on an edge 125 of the protruded coin, and the coin can be put into a hooked state by the edge. Particularly, in the case of a coin 110*b* thinner in thickness than the held coin 110*a*, it is more easily hooked. Hence, two pieces of coins 110*a* and 110*b* can be connected in the radial direction and pushed up. It is also possible that more than three coin pieces are connected and moved.

If two pieces of coins enter into the denomination discriminating device 103 from the delivery opening 106 by the wheel 128, it is not possible to accurately detect the coins, one by one, by the denomination discriminating device 103. It is also not possible to calculate the monetary amount. There also arises a problem that a separation by a coin selecting device which is the next process is not normally performed, and the reliability of the coin processing operation is lost.

To eliminate such trouble, the protruded portion 130 exists. Further, this protruded portion 130 is a peripheral edge of the projection portion 115, and is positioned by facing a concave portion exit of the opposite side of the coin pushing portion 121 in the separating concave portion 113. As shown in FIG. 7, in the separating concave portion 113, when the coin 110*a* is entered, a gap is created between the coin and the concave portion exit edge portion, and there is the possibility that another coin can partially enter therein. Thus, another coin 110*b* can be hooked by the edge of the held coin 110*a*.

Figure 5:
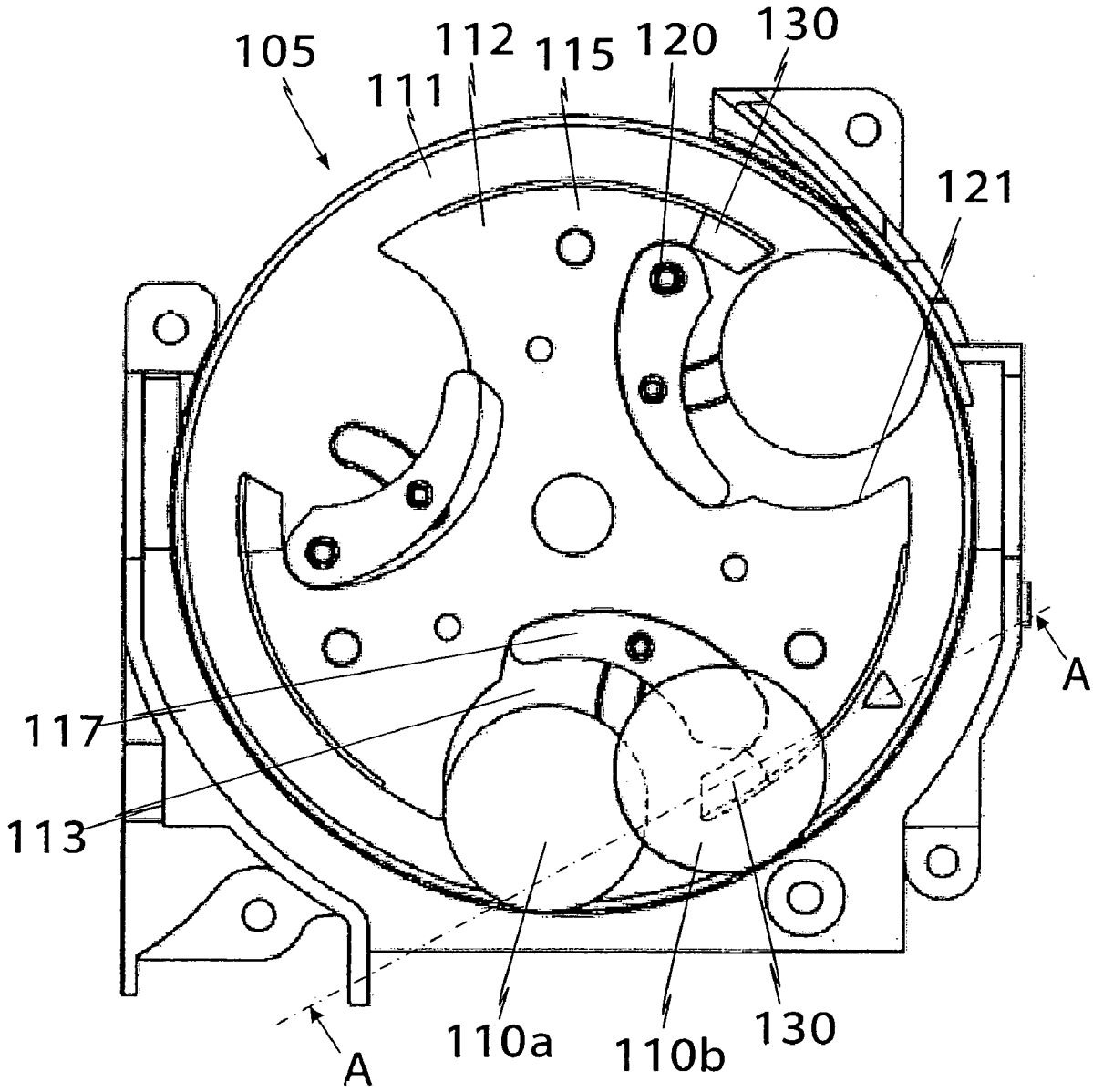
FIG. 5 is a schematic front view showing a state of the coin feeding operation by the rotating disk of the present invention.
Figure 6:
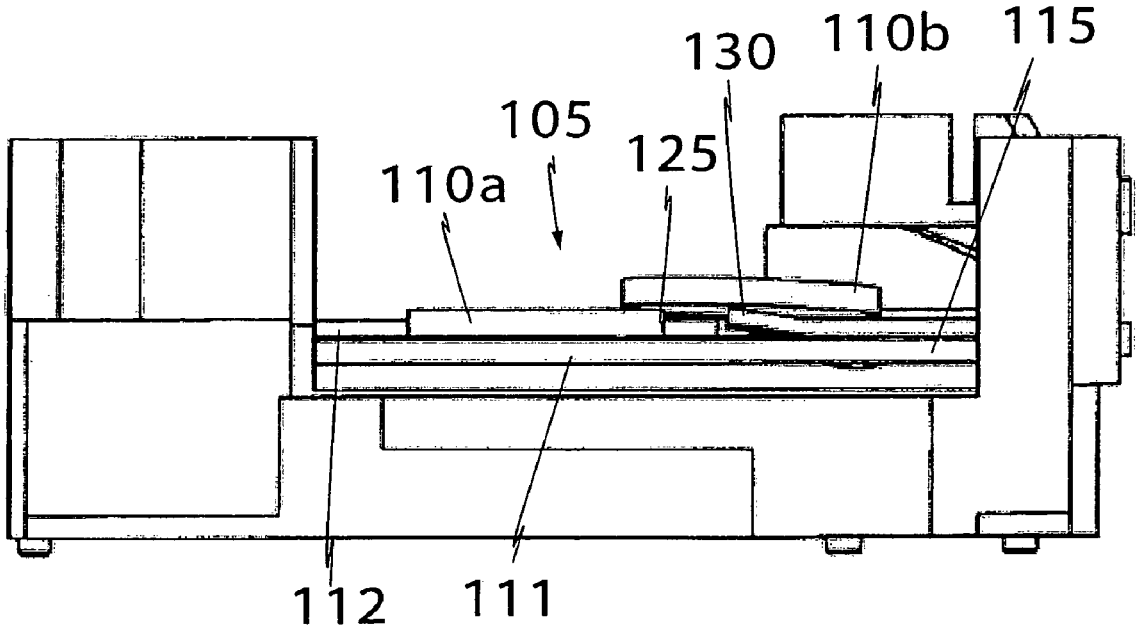
FIG. 6 is a sectional view cut along the line A-A of FIG. 5.

Hence, similarly to the embodiment, if there is a rotating disk provided with the protruded portion 130 extending upward from the upper surface of the pushing out disk by bending the top end of the projection portion 115 by a bending process and the like, accompanied with the rotation of the rotating disk 105, while the bulk-loaded coins inside the holding portion are agitated, the coin 110*b* receives an action as if to float in a direction to the upper surface of the rotating disk 105 by the protruded portion 130. The floated state of the coin 110*b* is shown in FIGS. 5 and 6. The top coin 110*b* is pushed up always by the protruded portion 130, that is, the bent portion, and between the upper surface of the rotating plate 111 and the underneath of the top coin 110*b*, there is a gap formed into which the coin 110*a* positioned in the separating concave portion 113 can advance. The coin 110*a* inside the separating concave portion 113 does not push the coin 110*b* by the edge 125 of the coin, but slips under the coin 110*b*.

In this manner, since another coin is disposed not to ride on the edge nor hook the held coin by the protruded portion 130, the connected feeding of two or more pieces of coins in the radial direction can be prevented, and the multiple coins are not entered into the denomination discriminating device 102. Hence, a reliable feeding of one piece each of the coins is performed, and a normal discrimination and a count are performed, thereby enhancing the operation reliability of the coin processing device.

In the present embodiment, though this protruded portion 130 has been taken as a bent portion provided by bending upward the top end of the projection portion 115, it may have an alternate structure of providing a protruded portion by making the thickness of a plate which is the material of the pushing out disk 112 thicker at the top end portion, or a structure providing a protruded portion of a separate body at the top end portion. As a protruded portion, it may function to float the coin on the rotating disk surface.

The top end of the projection portion 130 is formed on the arched end surface portion in which the inner side inner surface of the moving body 117 and the coin push ahead portion 121 are matched so as to take charge of a part of the circle 160 of the assumed line defining the size of the separating concave portion.

Further, as another embodiment for eliminating the connected feeding of extra coins, another configuration may be found suitable as shown in FIGS. 9 to 16, wherein a flexible coin separation baffle plate 140 is provided so as to extend into a rotating route of the rotating disk 105, and moreover, the baffle plate can be put into a sliding state with the upper surface of the rotating disk to scrape off extraneous coins.

Similarly as described above, when an extra coin is hooked by the held coin itself held by the rotating disk 105, that hooked coin is hoisted up to the vicinity of the opening 106, and is about to ride on the receiving portion 127. In such a case, the rode coin also drops off by a gravitational force, and basically other than the held coin does not ride on the receiving portion 127. However, because the rotating disk 105 is small and the coin is prone to be thrown away in the peripheral direction upon receipt of the gravitational force caused by the rotating disk 105 or the coins mutually hit against each other and integratedly move so as to affect the other coin, a coin which is supposed to drop off sometimes ends up riding on the receiving portion 127.

Hence, the baffle plate 140 preferably having elasticity is extendingly disposed in the rotating route so that the plate 140 hangs from above on the upper surface of the rotating disk 105, and moreover, the top end of the baffle plate 140 is provided so as to contact the upper surface of the rotating disk 105, that is, the upper surface 111S of the rotating circular plate 111. The baffle plate 140 can be made of a synthetic resin member, for example, an elastic plate integrally formed by a polycarbonate and the like. Further, since the baffle plate 140 is in a sliding friction contact with the rotating disk, if the material is a resin material having abrasion resistance, a life span can be improved, and this is preferable.

Figure 9:
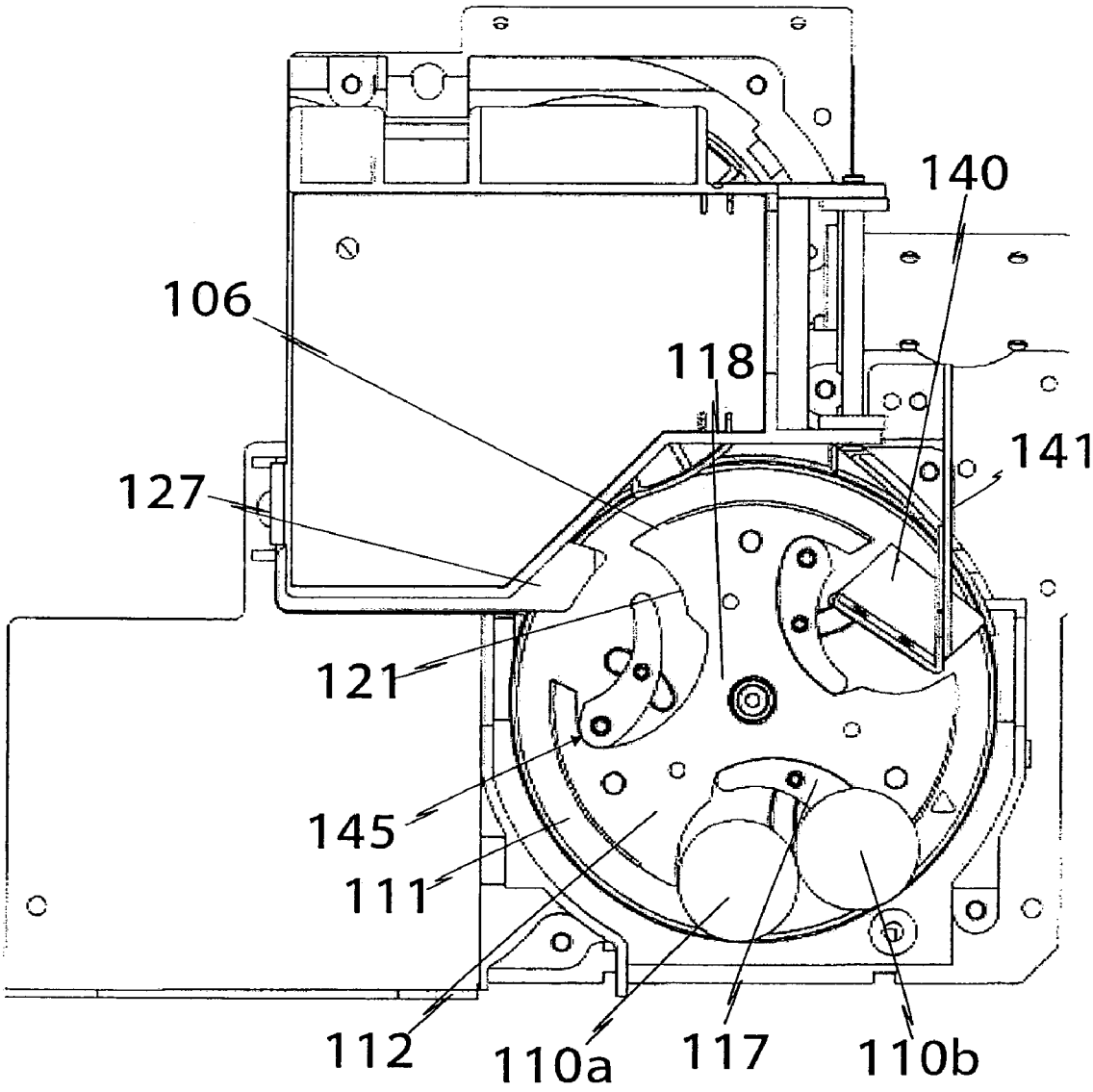
FIG. 9 is a front view of the coin feeding device showing the structure according to another embodiment enabled to prevent the coin connected feeding of the present invention.
Figure 10:
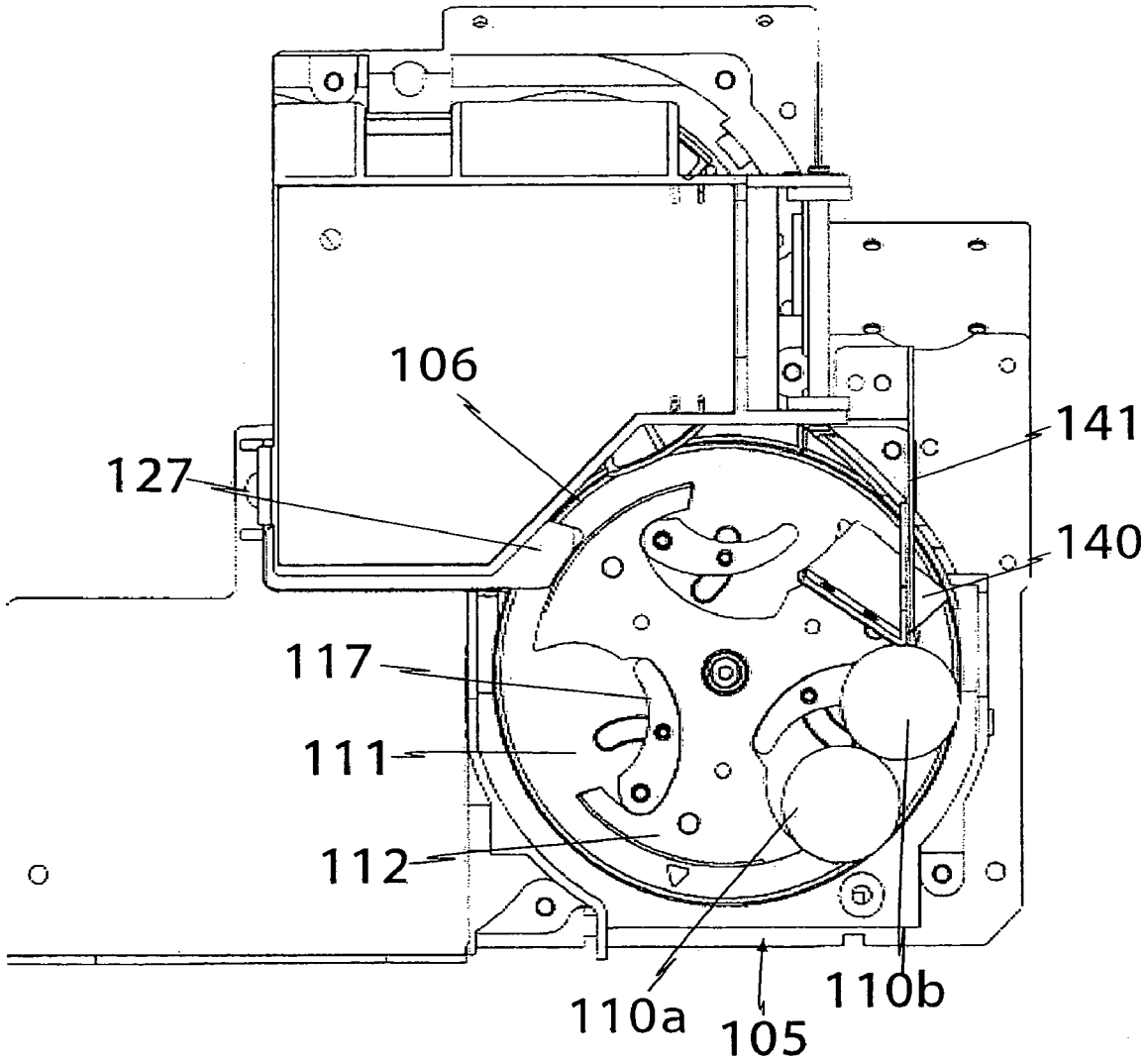
FIG. 10 is a front view showing an operation process cycle of the coin feeding by the coin feeding device of FIG. 9.
Figure 11:
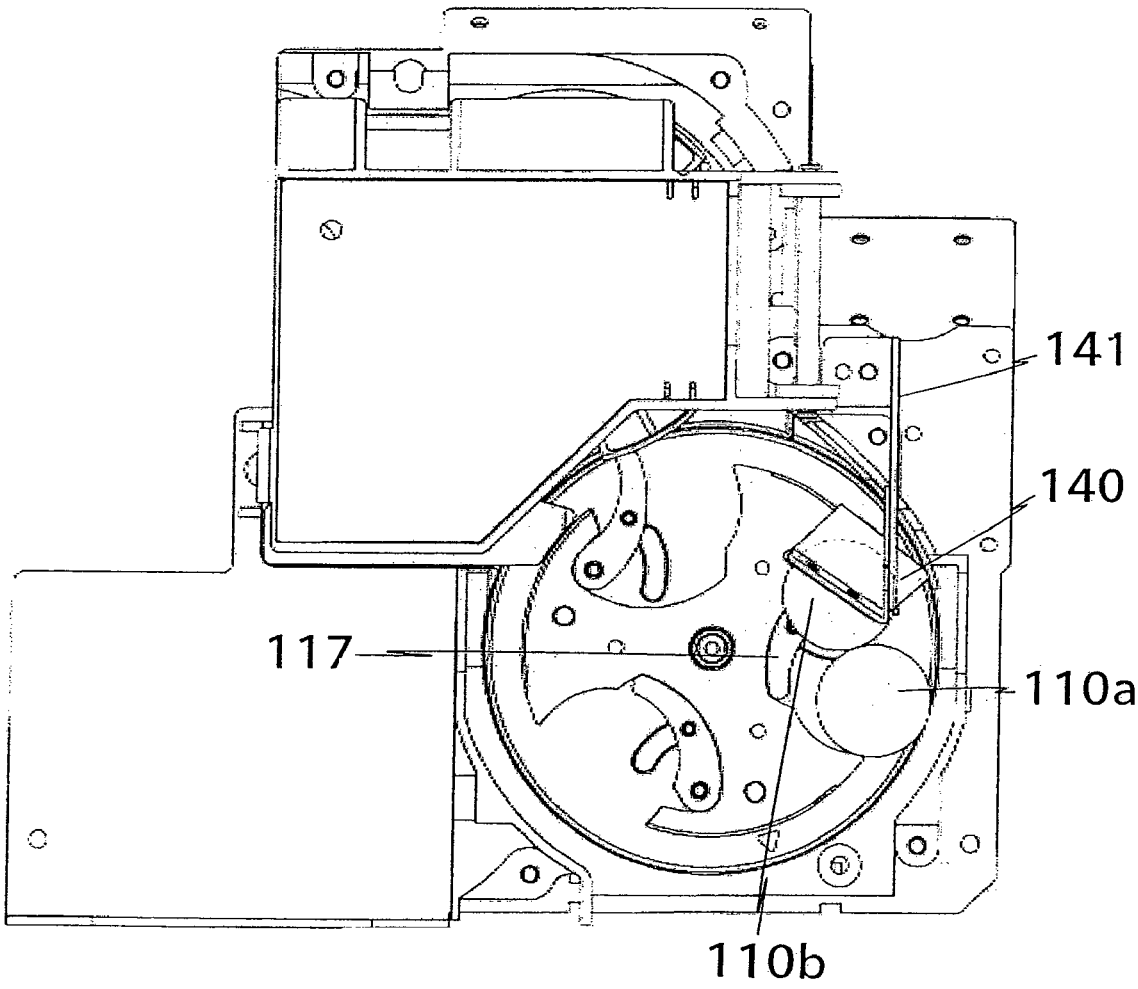
FIG. 11 is a front view showing the further next operation process of the coin feeding.

The baffle plate 140 is attached to a holding bowl 104 by a support arm 141. The top end of the baffle plate 140 contacts not only the upper surface of the rotating circular plate 111, but also the peripheral edge of the projection portion 115 of the pushing out disk, and is disposed so as to approximately occupy the outer peripheral portion of the rotating disk 105. As a result, at any position in the vicinity of the outer peripheral portion, as shown in FIG. 9 and the like, even when another coin 110*b* is connected to the held coin 110*a* and is lifted, the coin 110*b* hits against the baffle plate 140 so that it may push and bend the baffle plate 140. Thus, the coin 110*b* conversely receives a rebound elastic force from the baffle plate 140, and is repelled and dropped off. In this way, the connected feeding of the coins is prevented.

Figure 12:
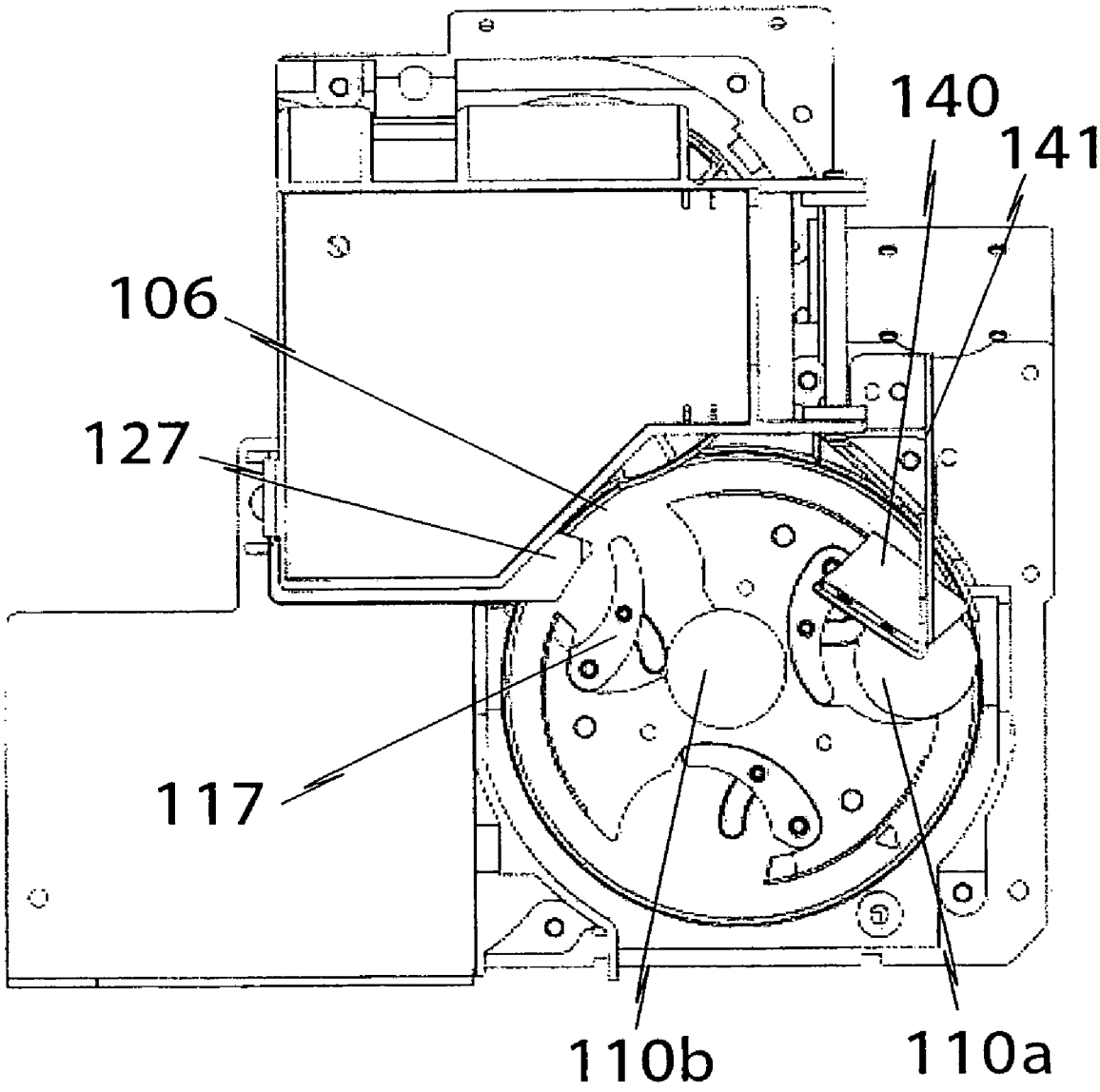
FIG. 12 is a front view showing the further next operation process of the coin feeding.
Figure 13:
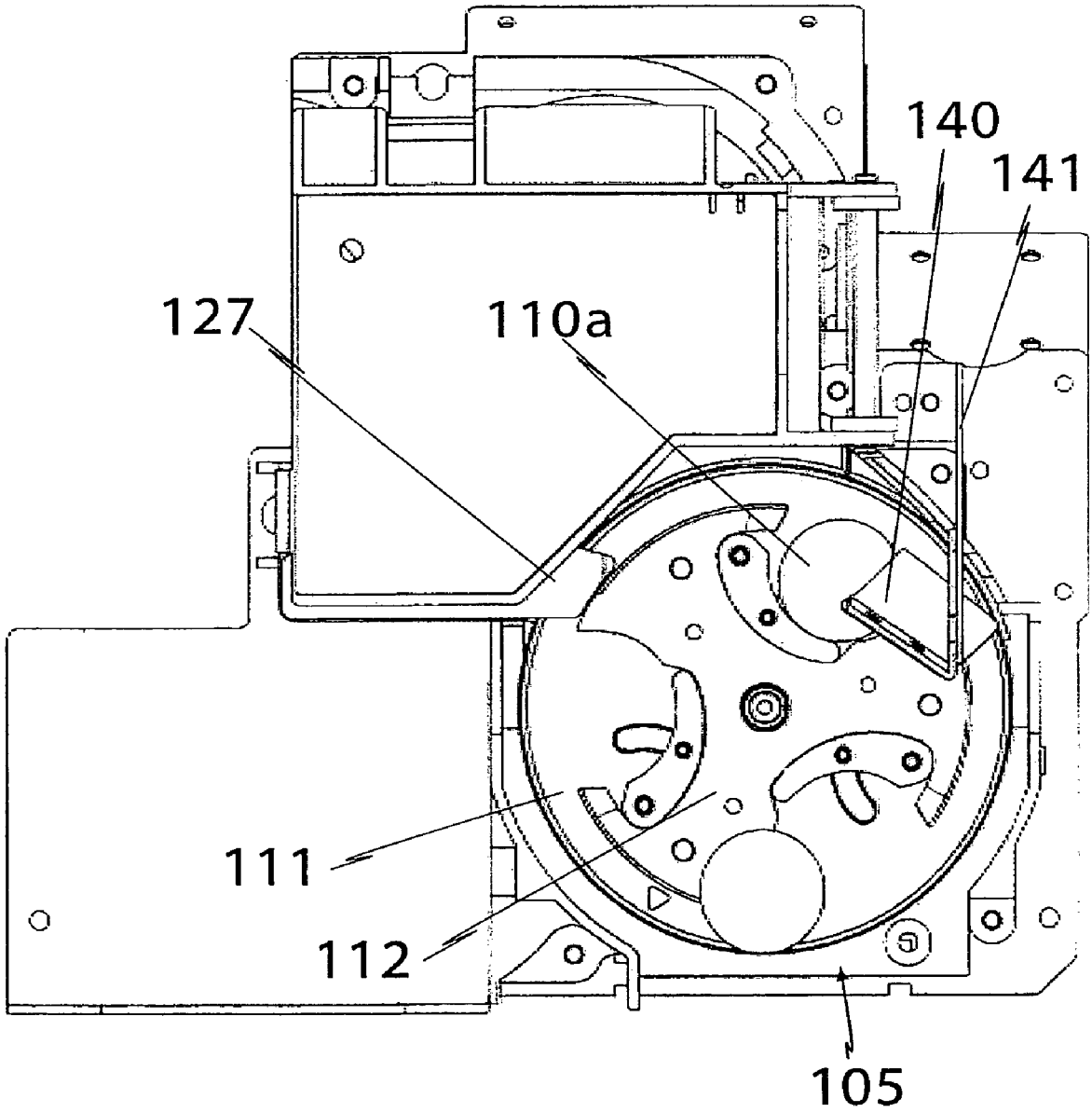
FIG. 13 is a front view showing the further next operation process of the coin feeding.
Figure 14:
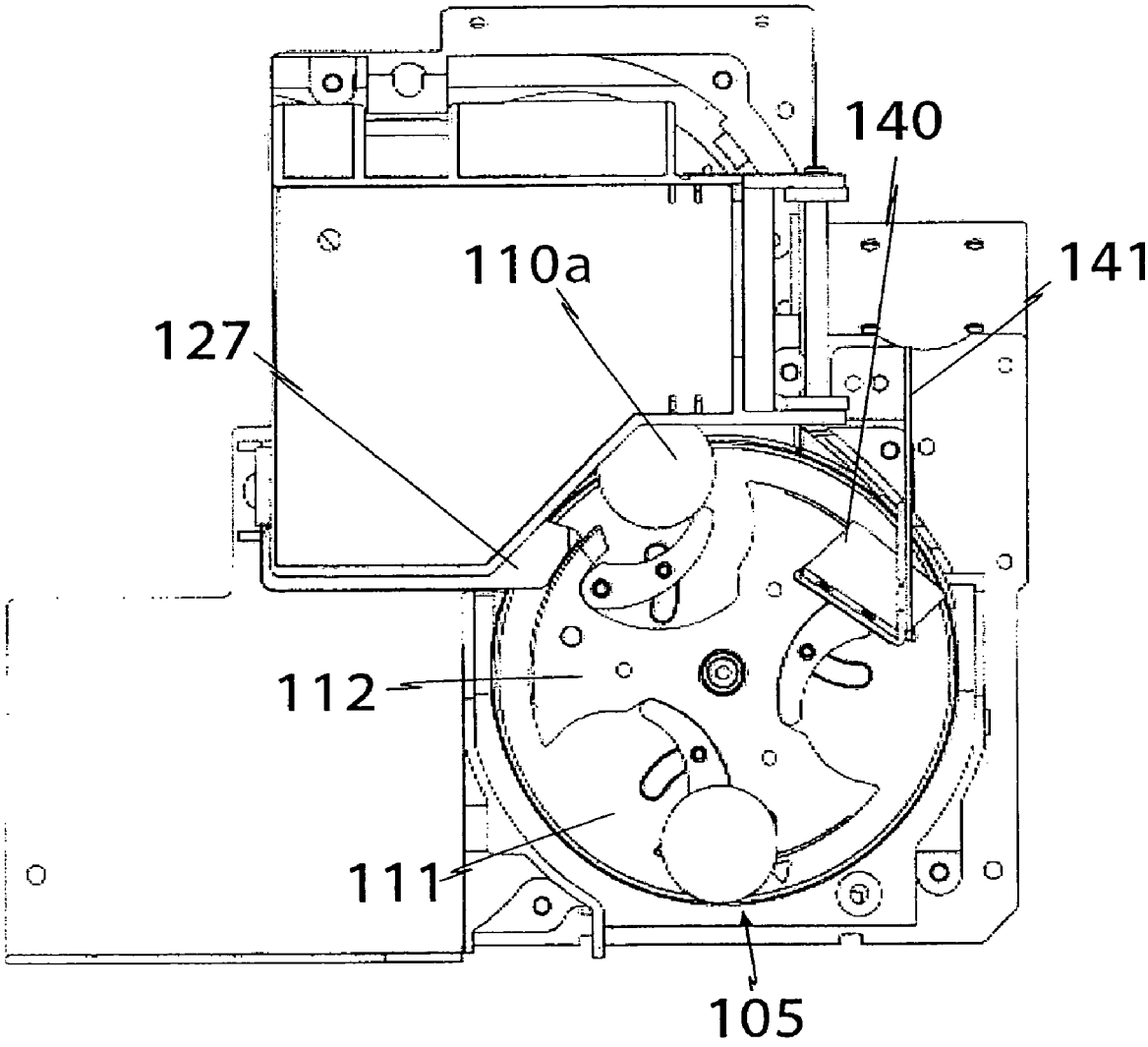
FIG. 14 is a front view showing the operation process when the coin is certainly fed one piece only to the next process.
Figure 15:
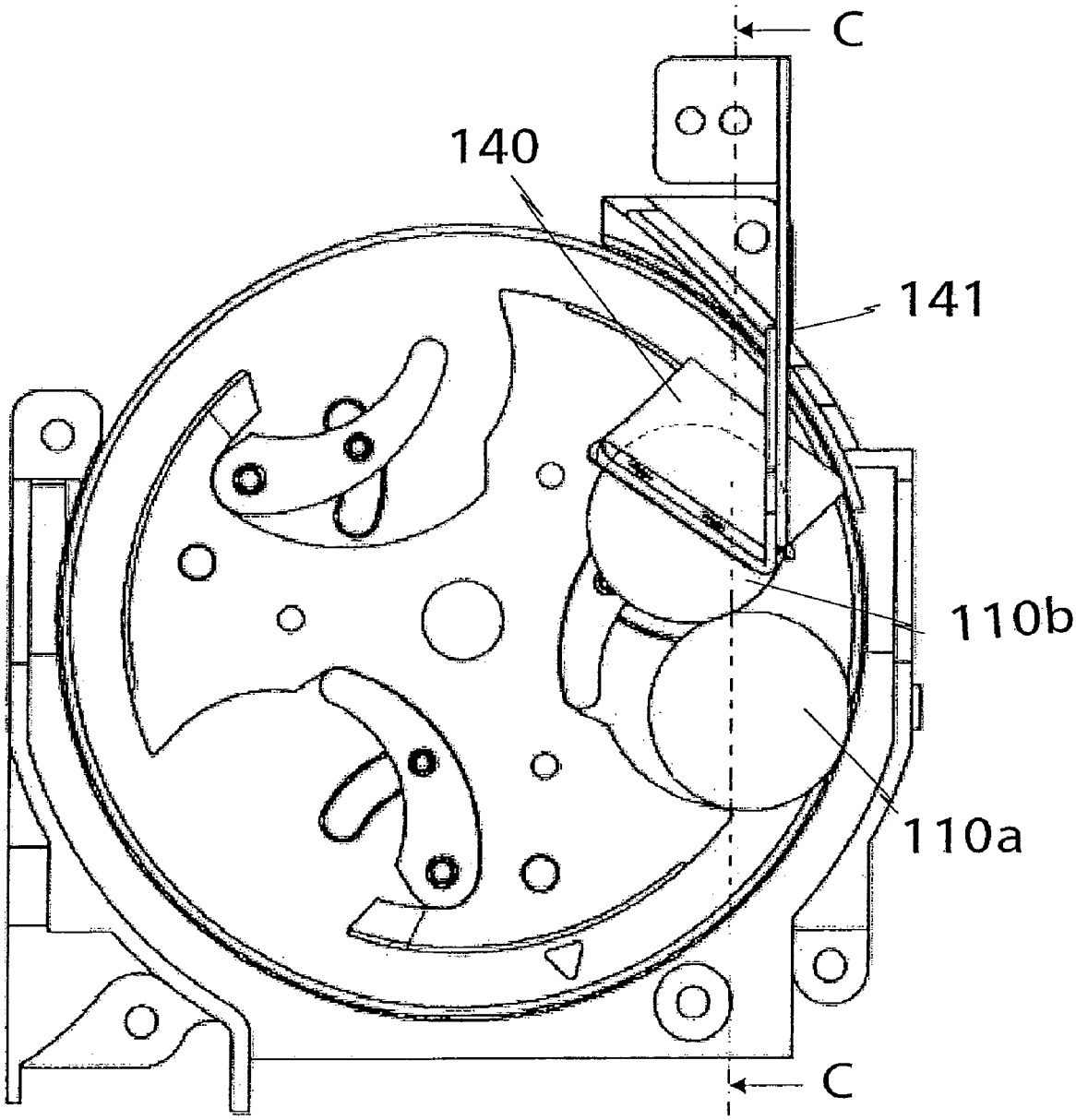
FIG. 15 is a front view showing the rotating disk only in an operation cycle of FIG. 11.
Figure 16:
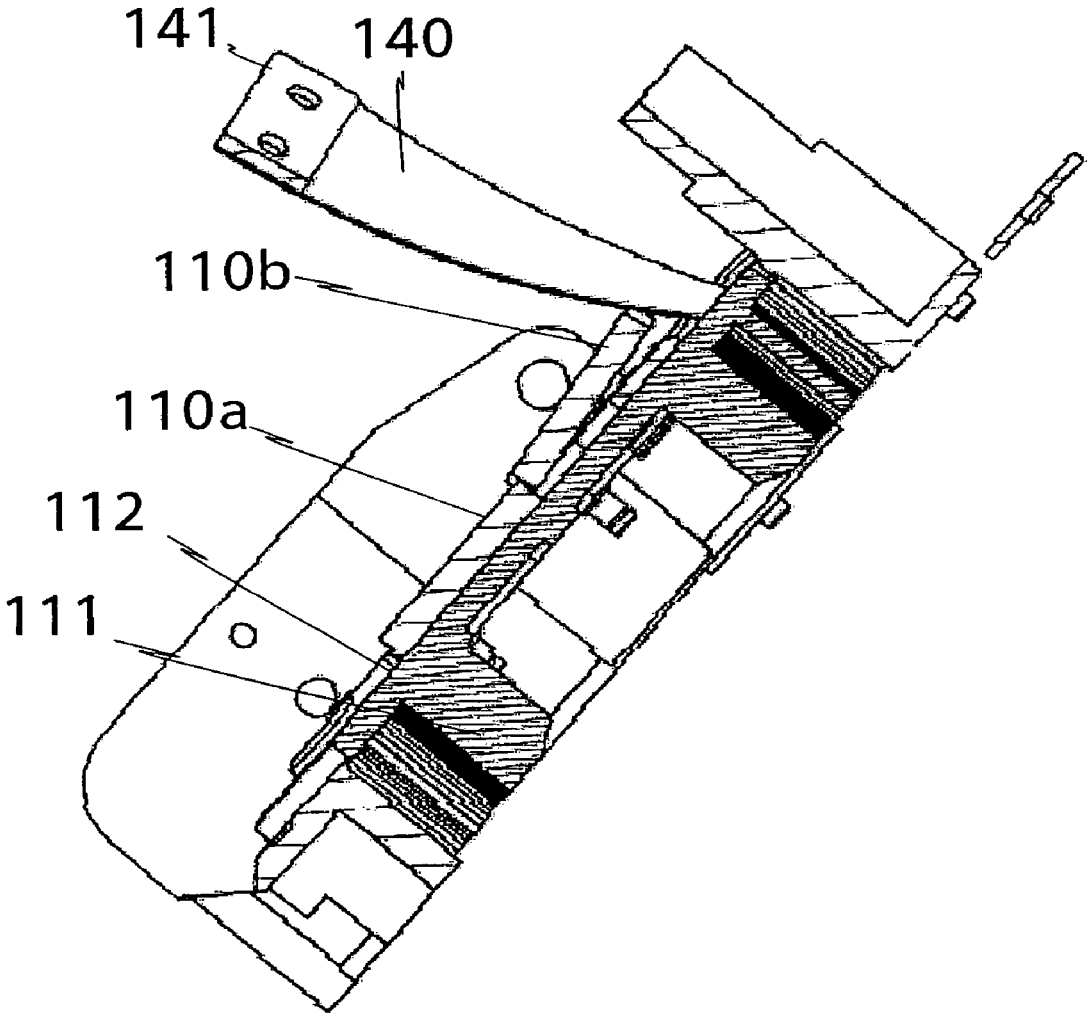
FIG. 16 is a sectional view cut along the state C-C in FIG. 15.

FIGS. 9 to 14 sequentially show a series of these operations. Here, the position at which the baffle plate 140 is located is set in advance at a position hitting against the coin 110*b* at a point of time earlier than the moving body 117 moves to such positions as shown in FIGS. 13 to 14 and starts moving so as to push out the held coin. Thus, any coin 110*b* hooked by the held coin 110*a* and arriving at this position is separated and dropped in advance by the elastic force of the baffle plate 140 as shown in FIG. 12 before the moving body 117 starts operating. Hence, the process of lifting up the held coin 110*a* by the moving body 117 is not affected. In this way, only one piece of coin can be fed to the next process.

In the present embodiment, though the baffle plate 140 has been assumed to be an elastic plate having an elastic force by itself, another configuration can be adopted in which the plate member biased to a direction reverse to the rotating direction by biasing device such as a spring and the like is disposed, and opposing to the pushing force of the coin, a snapping force is applied to the coin from the plate member.

Figure 17:
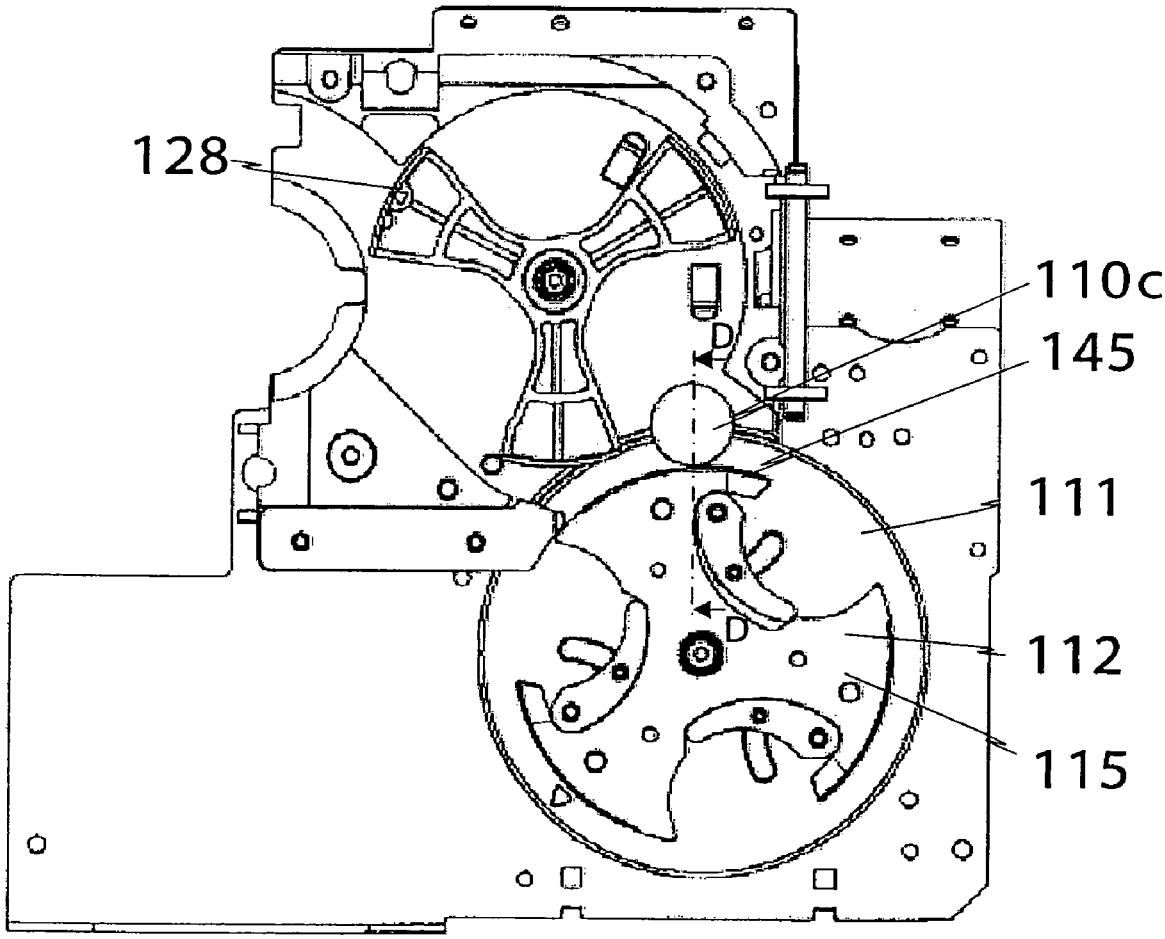
FIG. 17 is a schematic front view showing a state of the coin feeding operation by an improved rotating disk in which an R shaped portion is provided by chamfering the outer peripheral end of the present invention.
Figure 18:
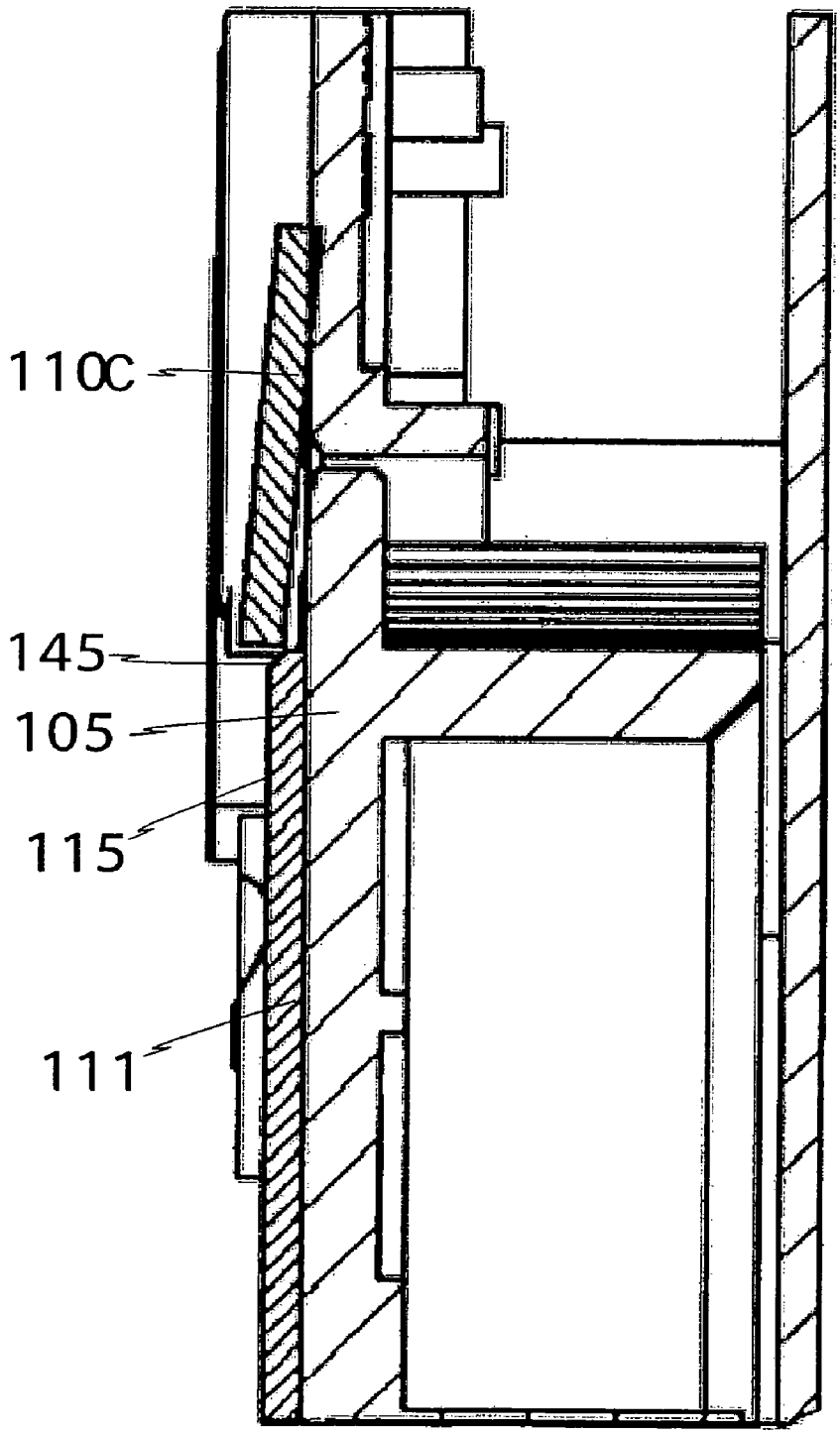
FIG. 18 is a sectional view cut along the line D-D in FIG. 17.

Further, to perform a similar coin dropping operation, it is possible to provide a chamfering portion 145 in the shape of an R in a predetermined range in the peripheral edge of the projection portion 115 of the pushing out disk 112 as shown in the rotating disk of FIG. 4 is also one of the applicable methods. This embodiment is shown in FIGS. 17 and 18. As shown in FIG. 18, even when a coin 110*c* moves and rides along the outer peripheral portion of the projection portion 115 by the rotation of the rotating disk 105, it is easily dropped off by the chamfering portion 145, and therefore, the coin is prevented from continuing to ride the peripheral portion of the rotating disk. The chamfering portion 145 is formed in a predetermined range from the position where the projection portion 115 is located, and is not allowed to be extended to the portion close to the coin pushing portion 121. This is because if the chamfering portion 145 exists close to the coin pushing portion 121, the coin is prone to escape by the chamfering portion 145 when entering the separating concave portion 113, and the coin entrance is prevented from being affected.

Figure 19:
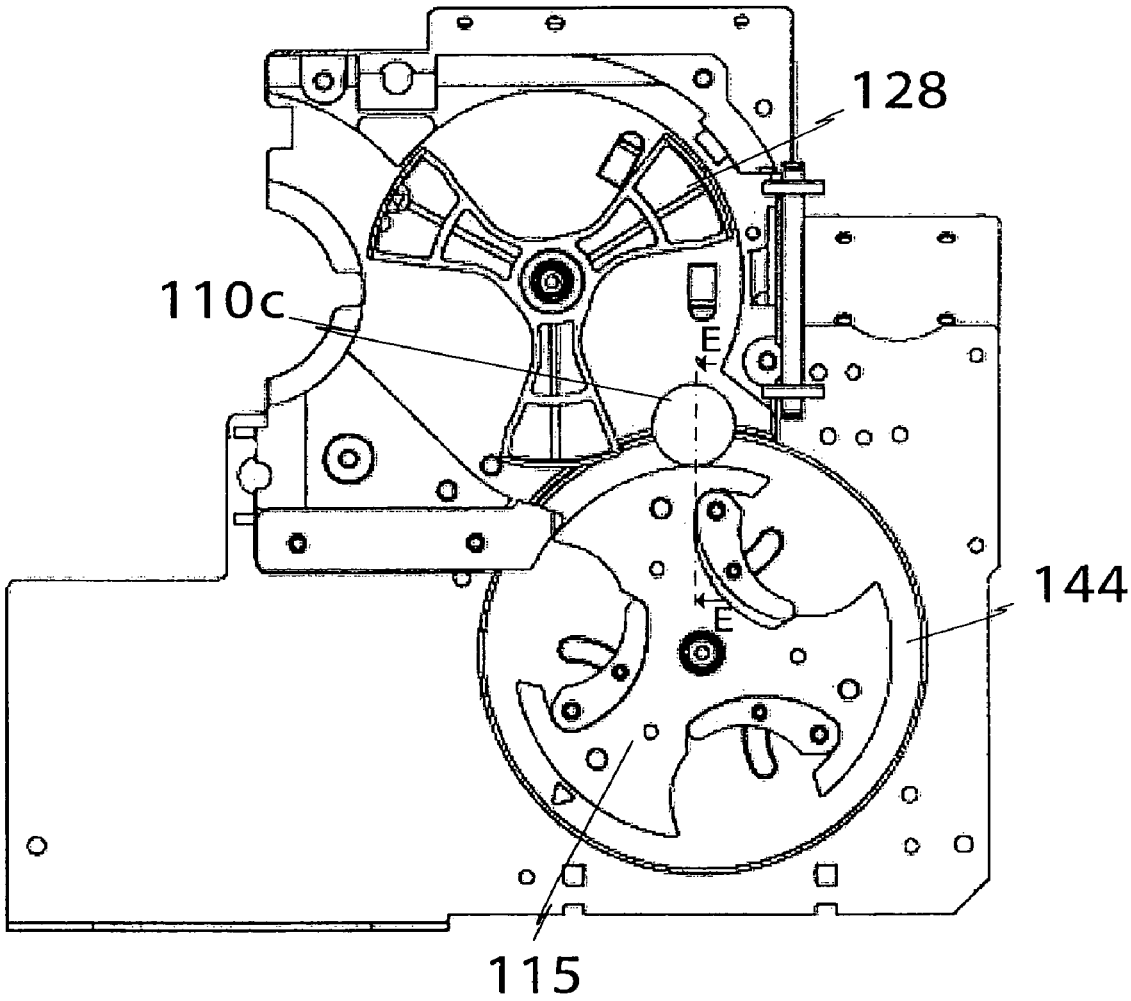
FIG. 19 is a schematic front view for explaining a trouble of the coin feeding by the rotating disk before improvement having no R shaped portion in the outer peripheral end such as the present invention.
Figure 20:
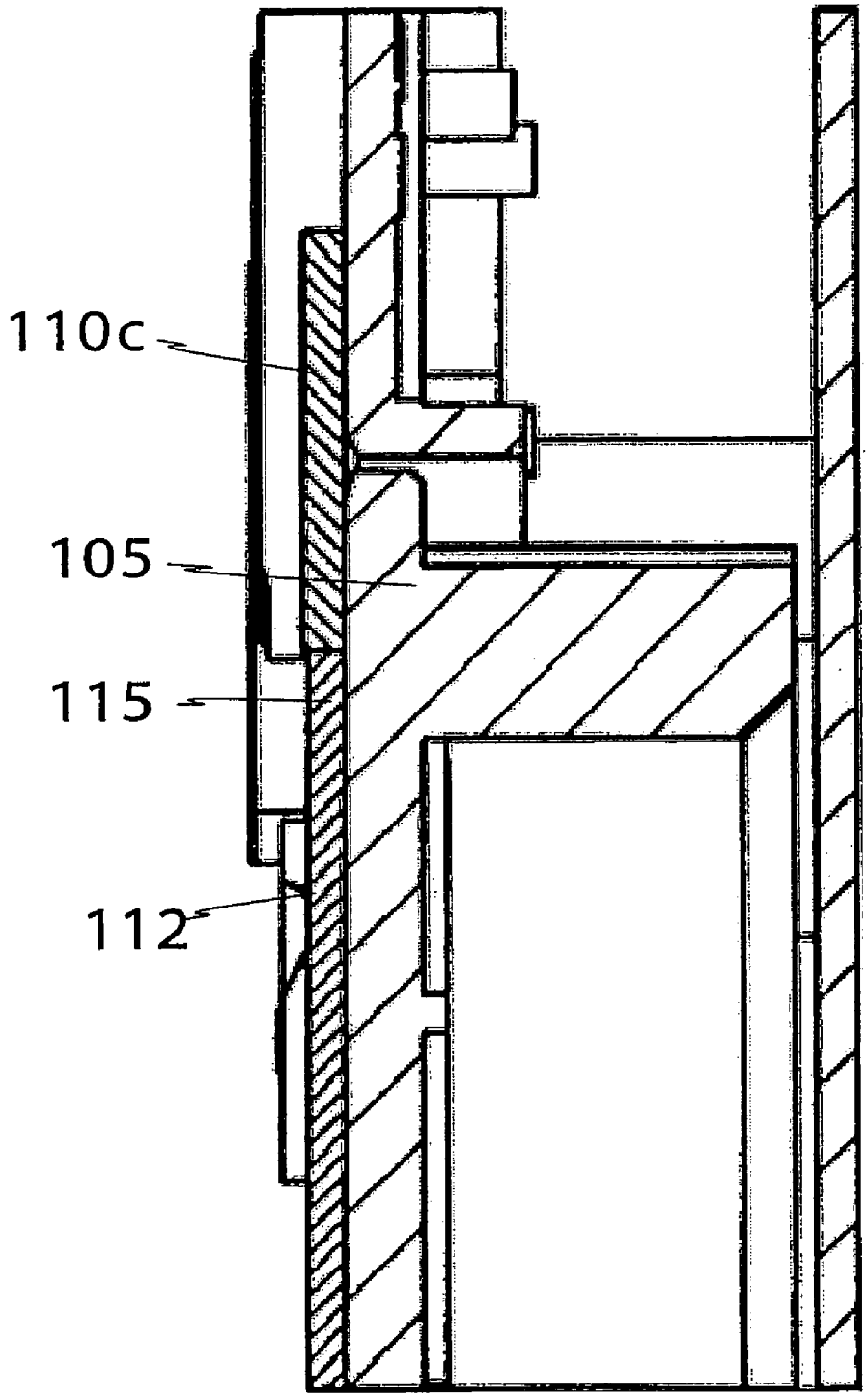
FIG. 20 is a sectional view cut along the line E-E in FIG. 18.

In the case of the rotating disk 105 where such an R shaped chamfering portion 145 does not exist in the projection portion 115 of the pushing ahead disk 112, as shown in FIGS. 19 and 20, the coin 110*c* sometimes rides on the edge portion of the projection portion 115. This is because the coins inside the holding portion are agitated by the rotation of the rotating disk and intricately move, and thus, the coins come up to the upper position for some reasons, and end up riding the outer peripheral portion of the rotating disk, that is, a peripheral end edge portion 144 of the pushing ahead disk 112. Such a state similarly occurs even in the case of the coin moving connected on the held coin entering in the separating concave portion 113, thereby causing a connected feeding of multiple coins.

Hence, even when the coin rides on the outer peripheral portion of the pushing out disk 105 in this manner, as shown in FIG. 18, the coin 110*c* is allowed to easily slide off by the R shaped chamfering portion 145, and therefore, even if the coin 110*c* is rode on the outer peripheral portion, it is not dropped off nor is it transferred into the denomination discriminating device 103, and the entering of two pieces of the coins will not occur. Thus, only the normal coin enters, and therefore, the accurate discrimination of the coins one by one is executed, so that an efficient performance of the coin processing device can be maintained.

Next, the operation of the present embodiment will be described. When the coin 110 is put into the holding portion, it is moved to the rotating disk 105 side by the inclination of the holding bowl 104, and contacts the rotating disk 105 and the pushing out disk 112.

The rotating disk 105 detects the input of the coin, and is automatically rotated full-time. By the rotation of the rotating disk 105, the coin 110 is agitated by the projection portion 115, and advances into the separating concave portion 113. At a position other than the vicinity of the coin denomination discriminating device 103, the moving body 117 is positioned at the receiving portion 118, and hence it is at a coin receiving position.

Consequently, the coin 110 is held as one piece only at the separating concave portion 113 which is defined by the pushing ahead portion 121 of the projection portion 115 and the arched surface of the moving body 117. That is, since the outer periphery of the coin 110 is guided by a holding ring 107, the separating concave portion 113 is formed slightly deeper in depth than the diameter of the maximum diameter coin it will hold one piece only of the maximum diameter coin.

Further, since its depth is below twice the diameter of the minimum diameter coin, the minimum diameter coin is unable to advance two pieces into a diameter direction of the rotating disk 105. Further, the concave portion 113 is unable to line up two pieces of the minimum diameter coins in the peripheral direction of the rotating disk 105. Consequently, the minimum diameter coin is held one piece only in the separating concave portion 113. The coin 110 held in the concave portion 113 is moved to the denomination discriminating device 104 side by the rotation of the rotating disk 105. In other words, the coin 110 is moved from downward to upward.

At this time, the coin 110 is pushed and moved by the coin pushing portion 121, and almost no force is applied to the moving body 117.

When the moving body 117 moves to the vicinity of the denomination discriminating device 104, it enters a coin feeding action.

As a result, the moving body 117 is pivotally moved clockwise with the axis 120 as a pivot support point. Consequently, the moving body 117 pushes the coin 110 positioned at the separating concave position 113 to the radial direction of the rotating disk 105 from the lateral side, and therefore, the coin 110 is pushed out from the separating concave portion 113.

While the moving body 117 pivots so as to return to the original inside of the concave portion, the ejected coin 110 passes through the opening 106. The coin, having passed through the opening 106, is further fed into the denomination discriminating device 103 by the rotation of the wheel 128 inside the device, and is transferred to the subsequent process of denomination discrimination.

In a series of these coin feeding operations, when a phenomenon occurs in which another coin is hooked and lifted by an edge protruded from the concave portion of the coin held in the separating concave portion 113 of the rotating disk 105, a lifting action and a dropping off action work on the coin lifted while being hooked by the upward protruded portion 130 which is provided so as to face the exit of the separating concave portion 113 in the outer peripheral portion of the pushing out disk 112, the R shaped chamfering portion 145 of the peripheral edge of the pushing out disk, and moreover, the baffle plate 140 having an elasticity provided in the rotating route, thereby any trouble such as two or more pieces of the coins being connected and transferred can be prevented. Hence, a coin feeding operation is performed in a state in which the rotating disk definitely holds only the desired coin piece in a separating concave portion, and therefore the transferring of multiple coins to the next coin processing portion such as a denomination discriminating device and the like can be prevented, thereby realizing a coin processing device capable of performing highly accurate discrimination.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

The invention claimed is:

1. A coin feeding device for holding coins in a plurality of separate concave portions disposed on an upper surface of a rotary disk for sorting coins, one by one, and discharging the coins, comprising:

a coin pushing portion provided on the upper surface of the rotating disk, and formed on a first side of each of said separate concave portions which extend in multiple radial patterns to contact and push a coin in the respective concave portions;

a moving body provided in each of said separate concave portions and operating so as to push out a coin from the separate concave portion at a predetermined discharge position and a protruded portion protrudes upward from the upper surface of the rotating disk at a concave exit portion on a second side of each such separate concave portion opposite from the first side of the coin pushing portions, at a peripheral edge of said rotary disk wherein any extraneous coins carried by the rotary disk will be elevated and discharged from the rotary disk by contact with the protruding portion that extends above the upper surface of the rotary disk and the coin pushing portion.

2. The coin feeding device according to claim 1, wherein a rotating route of the rotary disk is provided with an elastic baffle plate, the top end of which contacts the outer peripheral portion upper surface of said rotary disk.

3. The coin feeding device according to claim 2, wherein said baffle plate is disposed so that the top end thereof contacts the peripheral edge of said rotary disk.

4. The coin feeding device according to claim 2, wherein said baffle plate is an elastic plate of synthetic resin.

5. The coin feeding device according to claim 2, wherein said baffle plate is disposed in the rotating route of the rotary disk at a position before starting the coin pushing out operation by said moving body.

6. The coin feeding device according claim 1, wherein the outer peripheral portion of said projection portion of the rotating disk is provided with a R-shaped chamfering portion.

7. In a coin feeding device for delivering a single coin from a plurality of coins the improvement of a rotary disk, comprising;

a plurality of spaced radially open concave portions formed on the rotary disk, the openings of the concave portion are provided on a periphery of the rotary disk;

a coin pushing portion is provided on one side of each concave portion; and a protruding portion, extending upward at a distance further above a surface of the rotary disk than a top of the coin pushing portion is provided on the other side of the concave portion adjacent the periphery wherein any extraneous coin carried by the rotary disk when forced onto the protruding portion will be elevated and dislodged from the rotary disk.

8. The coin feeding device of claim 7 further including a baffle plate mounted upstream of a delivering position of the coin and contacting the peripheral surface of the rotary disk above the open concave portions to remove extraneous coins from the rotary disk.

9. The coin feeding device of claim 7 wherein the rotary disk has a circular base plate and a pushing out disk, in each open concave portion and a plurality of spaced radial projecting portions are positioned on the circular base plate, the circular base plate exposed between the radial projecting portions to form coin separating concave portions for receiving coins.

10. The coin feeding device of claim 9 wherein the pushing out disk is stacked on top of the circular base plate.

11. The coin feeding device of claim 9 wherein the circular base plate and pushing out disk are integral.

12. The coin feeding device of claim 11 further including a reduction gear integrally formed on the circular base plate.

13. The coin feeding device of claim 9 wherein the circular base plate coin separating concave portions each include a cam groove.

14. The coin feeding device of claim 9 wherein the protruding portion is cantilevered to extend into the coin separating concave portion.

15. The coin feeding device of claim 14 wherein the protruding portion is bent upward and spaced from the circular base plate.

16. The coin feeding device of claim 15 wherein the circular base plate and the pushing out disk are formed separately and connected together in a co-axis stacked arrangement.

* * * * *

UNITED STATES PATENT AND TRADEMARK OFFICE

CERTIFICATE OF CORRECTION

PATENT NO. : 7,654,891 B2
APPLICATION NO. : 11/582935
DATED : February 2, 2010
INVENTOR(S) : Enomoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 577 days.

Signed and Sealed this

Twenty-third Day of November, 2010

David J. Kappos

David J. Kappos
*Director of the United States Patent and Trademark Office*